US005718208A

United States Patent [19]

Brautigan et al.

[11] Patent Number: 5,718,208

[45] Date of Patent: Feb. 17, 1998

[54] FUEL VAPOR MANAGEMENT SYSTEM

[75] Inventors: Jeffrey Joseph Brautigan, Plymouth; Alex Larry Hummer, Ann Arbor; Jeong Yeol Kim, Troy, all of Mich.

[73] Assignee: Ford Motor Company, Dearborn, Mich.

[21] Appl. No.: 714,738

[22] Filed: Sep. 16, 1996

[51] Int. Cl.[6] ..... F02M 33/02

[52] U.S. Cl. ..... 123/516; 123/509

[58] Field of Search ..... 123/509, 516; 417/335; 415/55.1, 55.5, 169.1

[56] References Cited

U.S. PATENT DOCUMENTS

| | | | |
|---|---|---|---|
| 4,538,958 | 9/1985 | Takei et al. | 415/55.5 |
| 5,070,849 | 12/1991 | Rich et al. | 123/509 |
| 5,146,901 | 9/1992 | Jones | 123/509 |
| 5,192,184 | 3/1993 | Nobuo et al. | 415/55.1 |
| 5,338,151 | 8/1994 | Kemmer et al. | 415/55.1 |
| 5,368,001 | 11/1994 | Roche | 123/516 |
| 5,482,021 | 1/1996 | Roche | 123/509 |
| 5,486,087 | 1/1996 | Treiber et al. | 415/55.1 |

FOREIGN PATENT DOCUMENTS

| | | | |
|---|---|---|---|
| 0175297 | 8/1986 | Japan | 415/55.1 |

OTHER PUBLICATIONS

Max Machinery, Inc. (1992) "Instruction Manual".

*Primary Examiner*—Thomas N. Moulis
*Attorney, Agent, or Firm*—Neil P. Ferraro

[57] ABSTRACT

A fuel vapor management system for an automotive vehicle includes a vapor tower in fluid communication with a vapor purge outlet of a fuel pump. A fluid treatment section, such as a screen, is disposed between the fuel pump vapor purge outlet and the vapor tower. The fluid treatment section reduces the size and momentum of purged vapor bubbles such that the purged vapor bubbles in the vapor tower may rise in the vapor tower and separate from liquid fuel thereby, allowing liquid fuel to flow out of the vapor tower and allowing fuel vapor to escape from the vapor tower away from the inlet of the fuel pump inlet.

20 Claims, 3 Drawing Sheets

FUEL VAPOR MANAGEMENT SYSTEM

FIELD OF THE INVENTION

The present invention relates generally to fuel vapor management for automobiles, and, more particularly to a system for handling fuel vapor purged from a fuel pump.

BACKGROUND OF THE INVENTION

Automotive fuel delivery systems typically include a reservoir in the fuel tank and a regenerative turbine fuel pump submerged in the reservoir to supply fuel to the engine. The purpose of the reservoir is to keep the pump inlet submerged under operating conditions which could otherwise expose the inlet, such as when the vehicle is operated on an incline with an almost empty fuel tank or during cornering maneuvers wherein fuel moves away from the fuel inlet.

Regenerative turbine fuel pumps are commonly used because they have a higher and more constant discharge pressure than, for example, positive displacement pumps. In addition, regenerative turbine pumps typically cost less and generate less noise during operation. A problem develops, however, when the fuel temperature rises and fuel vapor bubbles form within the fuel. Such a result is common because fuel pumps are regularly mounted within a fuel tank where high fuel temperatures result from a variety of reasons, including, for example, hot fuel recirculated from fuel injectors in the engine, rotary motion of the pump impeller, or high ambient air temperatures. If the vapor bubbles thus formed are not removed, the pump flow rate decreases or the pressure drops, resulting in decreased pump efficiency. Fuel vapor also results in pump noise as the pump impeller rotates. If such vapor is not properly vented, annoying venting noises may occur. A known method of removing the aforementioned fuel vapor bubbles is to provide a vapor purge orifice leading from the pumping chamber surrounding the impeller to the fuel tank so that the fuel vapor can bleed back into the fuel tank.

The inventors of the present invention have recognized certain disadvantages with prior art systems for handling fuel vapor. For example, if the purged vapor is allowed to collect near the inlet of the fuel pump, a vapor lock condition may result whereby fuel flow through the pump is reduced. This may occur because the vapor purge outlet is typically located near the inlet of the fuel pump. Moreover, because the fuel pump itself is disposed within the reservoir, the purged vapor has little chance to escape, thereby increasing the likelihood that the purged fuel vapor bubbles will undesireably be drawn into the fuel pump inlet.

SUMMARY OF THE INVENTION

An object of the present invention is to vent the purged fuel vapor bubbles away from the fuel pump inlet while separating the purged fuel vapor bubbles from the liquid fuel.

This object is achieved and disadvantages of prior art approaches overcome, by providing a novel fuel vapor management system for an automotive vehicle having a fuel tank and an internal combustion engine. In one particular aspect of the invention, the system includes a fuel pump for pumping fuel from the fuel tank to the engine. The fuel pump has a fuel pump inlet and a fuel pump vapor purge outlet for purging fuel vapor bubbles from the fuel pump. A vapor tower is in fluid communication with the fuel pump vapor purge outlet and a fluid treatment section is disposed between the fuel pump vapor purge outlet and the vapor tower. The fluid treatment section reduces the size and momentum of purged vapor bubbles such that the purged vapor bubbles in the vapor tower may separate from liquid fuel, thereby allowing liquid fuel to flow out of the vapor tower and allowing fuel vapor to escape from the vapor tower away from the fuel pump inlet.

In a preferred embodiment, the vapor tower includes a deflector for deflecting purged vapor bubbles upward in the vapor tower.

Also in a preferred embodiment, the vapor tower includes a vapor tower inlet for allowing fuel vapor and liquid fuel to enter therein. The ratio of the crosssectional area of the liquid fuel outlet to the vapor tower inlet is such that more fuel volume enters the vapor tower than exits the liquid fuel outlet. This allows the vapor bubbles to rise in the liquid fuel within the vapor tower.

To reduce fuel pump noise, the system also includes an isolator, formed of a material sufficient to dampen vibration between the fuel pump and the fuel tank, disposed within the fuel tank for mounting the fuel pump therein. The isolator includes an isolator vapor purge outlet between the fuel pump vapor purge outlet and the vapor tower inlet such that purged fuel vapor flows through the fuel pump vapor purge outlet, through the isolator vapor outlet and into the vapor tower vapor inlet. In addition, the fluid treatment section, such as a screen, may be assembled to the isolator.

An advantage of the present invention is that fuel vapor bubbles purged from the fuel pump are vented away from the fuel pump.

Another advantage of the present invention is that fuel vapor bubbles are separated from the liquid fuel.

Still another advantage of the present invention is that the likelihood of a vapor lock condition is reduced.

Yet another advantage of the present invention is that the fuel pump is isolated from the fuel tank such that any vibration of the fuel pump is not transmitted to the fuel tank.

Another advantage of the present invention is that manufacturing assembly ease may be obtained.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 6:
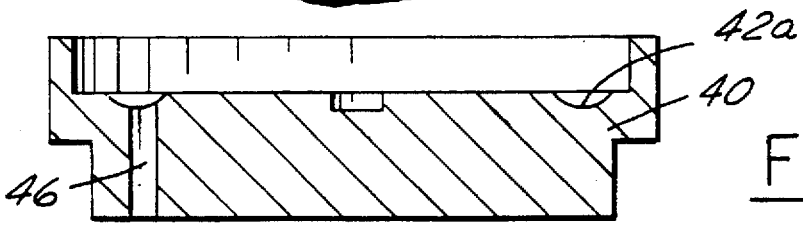
FIG. 6 is a section view of the fuel pump cover taken along line 6—6 of FIG. 5; and, FIG. 7 is an exploded perspective view of an isolator and screen according to the present invention.

Referring now to FIGS. 1 through 5, fuel vapor management system 10 for an automotive vehicle (not shown)

includes fuel pump 12 submerged within reservoir 14, having cover 15, for supplying fuel to fuel rail 16 of internal combustion engine 18. Reservoir 14 is in fluid communication with fuel tank 20 and is used to keep pump inlet 22 (see FIG. 5) submerged under operating conditions which could otherwise expose the inlet, as is known to those skilled in the art. Reservoir 14 remains full with fuel either by the use of a jet pump or other pumping device known to those skilled in the art and suggested by this disclosure or merely due to submergence of reservoir 14 in fuel tank 20. It should be noted that the cross sections shown in FIGS. 1, 2 and 6 do not pass through fuel inlet 22, which is therefore not shown in these views. Fuel pump 12 is an electric fuel pump controlled by controller 24 of engine 18.

Figure 2:
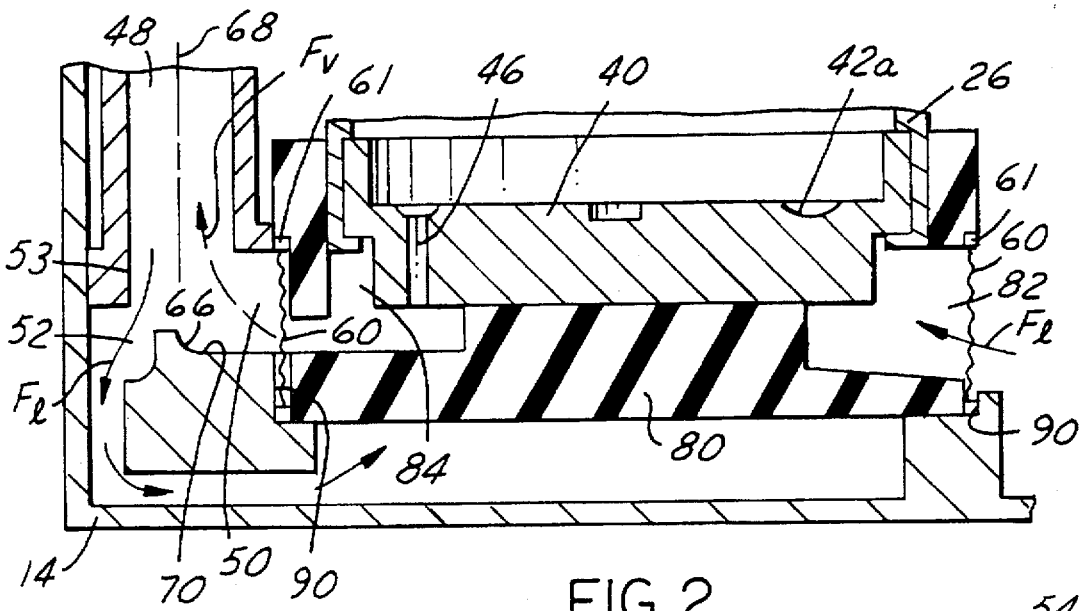
FIG. 2 is an enlarged view of the portion of the fuel vapor management system encircled by line 2 of FIG. 1.

Controller 24, which my comprise a conventional engine control microprocessor known to those skilled in the art, or a stand-alone processor, as desired, is charged with the task of operating fuel pump 12. Fuel pump 12 includes fuel pump casing 26, shown partially broken, and motor 28 mounted within casing 26. Motor 28 has shaft 30 extending therefrom, which passes through impeller housing 32, through opening 34 to engage impeller 36. Housing 32 comprises pump bottom 38 and pump cover 40. Pump bottom 38 and pump cover 40 cooperate to form pumping chamber 42, the bottom portion of which is shown in FIG. 2 as 42*a*. Impeller 36 is keyed to shaft 30 such that when shaft 30 rotates, impeller 36 rotates within housing 32. Thus, when fuel pump 12 is actuated by controller 24, fuel is drawn into inlet 22 (FIG. 5), pumped through pumping chamber 42, and flows to fuel rail 16 through fuel pump outlet 44. Fuel pump 12 also includes vapor purge orifice 46 formed in pump cover 40. Orifice 46 communicates with pumping chamber 42 to allow venting of fuel vapor generated therein.

Figure 1:
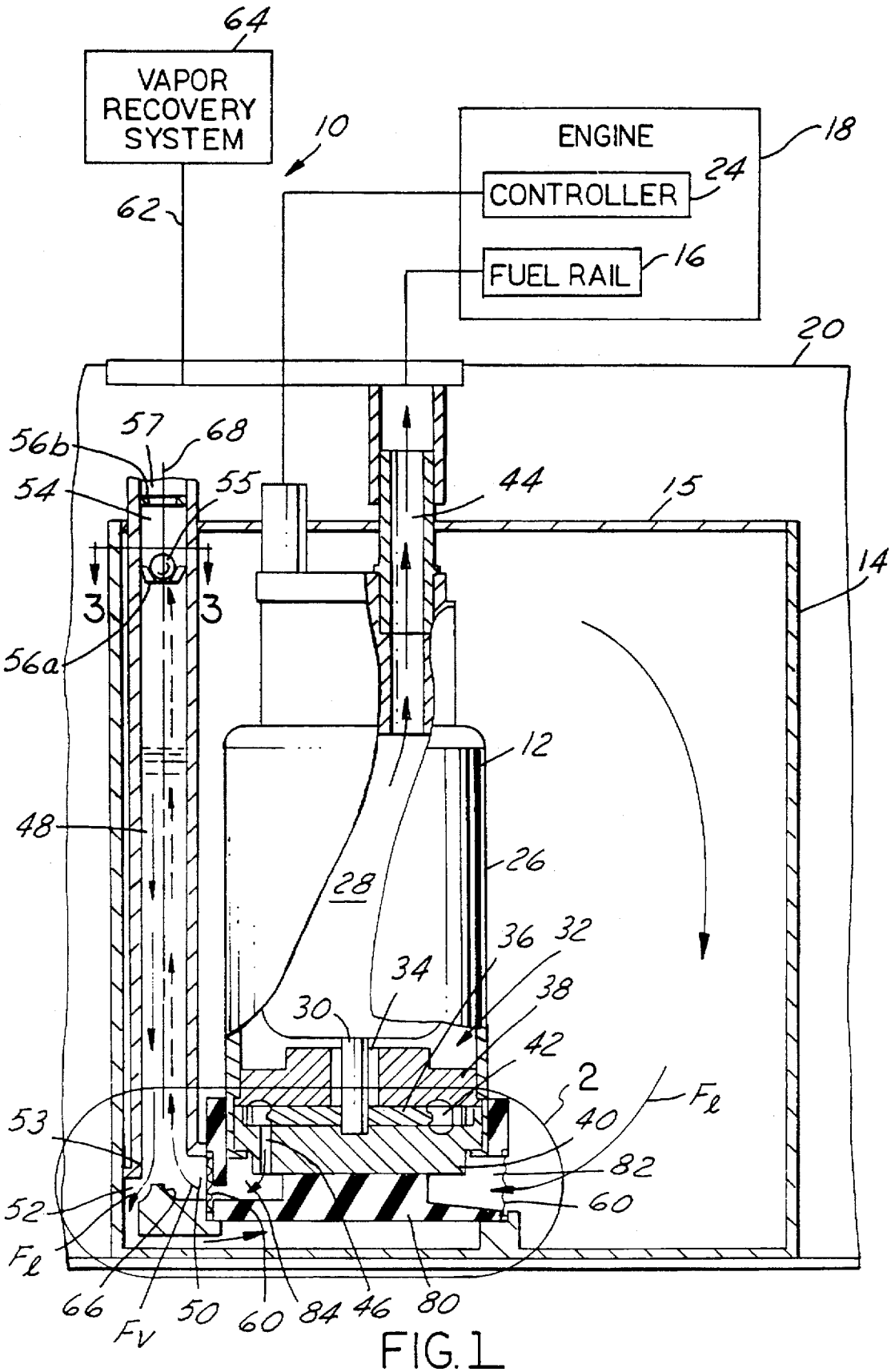
FIG. 1 is a diagrammatic view of a fuel vapor management system showing a vapor tower communicating with a vapor purge outlet of a fuel pump according to the present invention.
Figure 3:
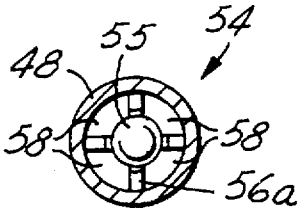
FIG. 3 is a view of the vapor tower taken along line 3—3 of FIG. 1.

Fuel vapor management system 10 also includes vapor tower 48 formed in reservoir 14 for collecting and handling fuel vapor bubbles as will become apparent hereinafter. Those skilled in the art will recognize in view of this disclosure that vapor tower 48 may be a separate pipe member attached to reservoir 14 or, preferably, integrally formed to reservoir 14, as shown. Vapor tower 48 has vapor tower inlet 50 formed at a bottom end thereof. Inlet 50 communicates with vapor purge orifice 46 of fuel pump 12. Vapor tower 48 also includes liquid fuel outlet 52, formed in sidewall 53 at a bottom end thereof, and communicates with reservoir 14. Check valve 54 is disposed at the top of vapor tower 48. As best shown in FIGS. 1 and 3, check valve 54 includes ball 55, and valve seats 56*a* and 56*b*. Valve seat 56*a* (FIG. 3) allows fuel vapor to pass through opening 58 and escape through vapor tower outlet 57. However, as will be further described hereinafter, liquid fuel will cause ball 55 to lift off valve seat 56*a* and seat against valve seat 56*b*, thereby preventing liquid fuel from escaping vapor tower 48 though check valve 54.

To aid in separating fuel vapor bubbles from liquid fuel, a fluid treatment section 60 is disposed anywhere between vapor purge orifice 46 and vapor tower 48. It should be noted that fluid treatment section 60 may be a perforated plate member, a sintered metallic plate member having an appropriate porosity, a container filled with filtering sand, a fabric filter, or other device, apparatus or assembly known to those skilled in the art and suggested by this disclosure. In the embodiment described herein, fluid treatment section 60 is a screen. Preferably, screen 60 is located just upstream of vapor tower inlet 50, as shown. Screen 60 has a mesh size sufficient to reduce both the size and the momentum of the vapor bubbles entering vapor tower 48. Accordingly, in a preferred embodiment, the size of the openings in screen 60 may be from about 70 microns to about 200 microns so as to reduce the momentum of the vapor bubbles by about 70%. In operation, as previously stated, as fuel pump 12 pumps fuel to fuel rail 16, any vapor or vapor bubbles formed in pumping chamber 42 is purged through vapor purge orifice 46. According to the present invention, the purged vapor bubbles flows through screen 60 where both the size and momentum of the bubbles are reduced. This reduce size and momentum allows the vapor bubbles to rise within vapor tower 48 due to the natural buoyancy of the bubbles relative to the liquid fuel in vapor tower 48. If the momentum of the vapor bubbles is too high, then the bubbles may not have a chance to float up in the vapor tower 48 and may even be pulled out through the liquid fuel outlet along with the liquid fuel. Screen 60, however, slows down the momentum of the vapor bubbles to allow them to rise in the vapor tower. Fuel vapor may then escape through check valve 54 and enter tank 20. As is known to those skilled in the art, the vapor in fuel tank 20 is then vented through vapor purge line 62 to vapor recovery system 64. Liquid fuel in vapor tower 48, which may also flow from vapor purge orifice 46, is then permitted to flow out of vapor tower 48 through liquid fuel outlet 52 and into reservoir 14. Of course, those skilled in the art will recognize in view of this disclosure that liquid fuel may flow directly into fuel tank 20. As a result, any purged vapor bubbles that otherwise may be ingested into fuel pump 12 are vented away while liquid fuel is permitted to return to the fuel tank.

Figure 4:
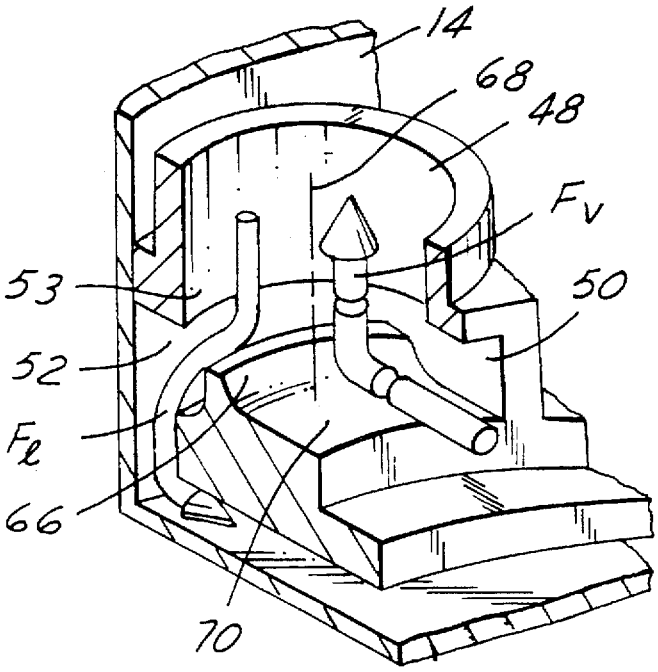
FIG. 4 is a diagrammatic perspective view of a portion of the vapor tower according to the present invention.

In a preferred embodiment, vapor tower 48 includes deflector 66, shown also in perspective view in FIG. 4, for further deflecting the flow of the fuel vapor bubbles upward in vapor tower 48, shown as dashed flow arrow "$F_v$", rather than straight out liquid fuel outlet 52 or solely relying on the buoyancy force of the vapor bubbles as previously described. Liquid fuel is permitted to flow out liquid fuel outlet 52 and into reservoir 14, as shown by solid flow arrow "F" The position of deflector 66 in vapor tower 48 is such that the flow of vapor bubbles is positioned to one side of the vapor tower 48 while the flow of liquid fuel is positioned to the other side of vapor tower 48, as shown in FIGS. 1 through 4. Thus, in a preferred embodiment, deflector 66 is positioned near the longitudinal axis 68 of vapor tower 48. Deflector 66 may be formed by a separate member disposed within vapor tower 48, or, as shown in this example, formed integrally into base 70 of vapor tower 48. Also, deflector 66 may have a fillet, as shown, a chamfer or the like as desired.

Inlet 50 may have a cross sectional area greater than the cross sectional area of outlet 52 such that more fuel volume (vapor and liquid) enters vapor tower inlet 50 than exits liquid fuel outlet 52. This causes the ball 55 of check valve 54 to seat against seat 56*b*. However, when sufficient vapor collects around ball 55, ball 55 falls or unseats from seat 56*b* so as to allow the vapor to escape. Once the vapor escapes, the liquid fuel again causes ball 55 to seat against seat 56*b*. If the area ratio of outlet 52 to inlet 50 is such that the more fuel volume exits outlet 52 than enters inlet 50, then ball 55 would seat against seat 56*a*. This is undesirable because contaminants may inadvertently flow into vapor tower 48 through openings 58 (see FIG. 3) in valve seat 56*a* of check valve 54. In addition, with the vapor tower 48 filled with liquid fuel, the vapor bubbles have a greater opportunity to rise within vapor tower 48. In a preferred embodiment the ratio of the cross sectional area of outlet 52 to inlet 50 is 1:3. It should be noted, however, that for the sake of clarity, vapor tower 48 is shown to be partially filled with liquid in FIG. 1.

Figure 7:
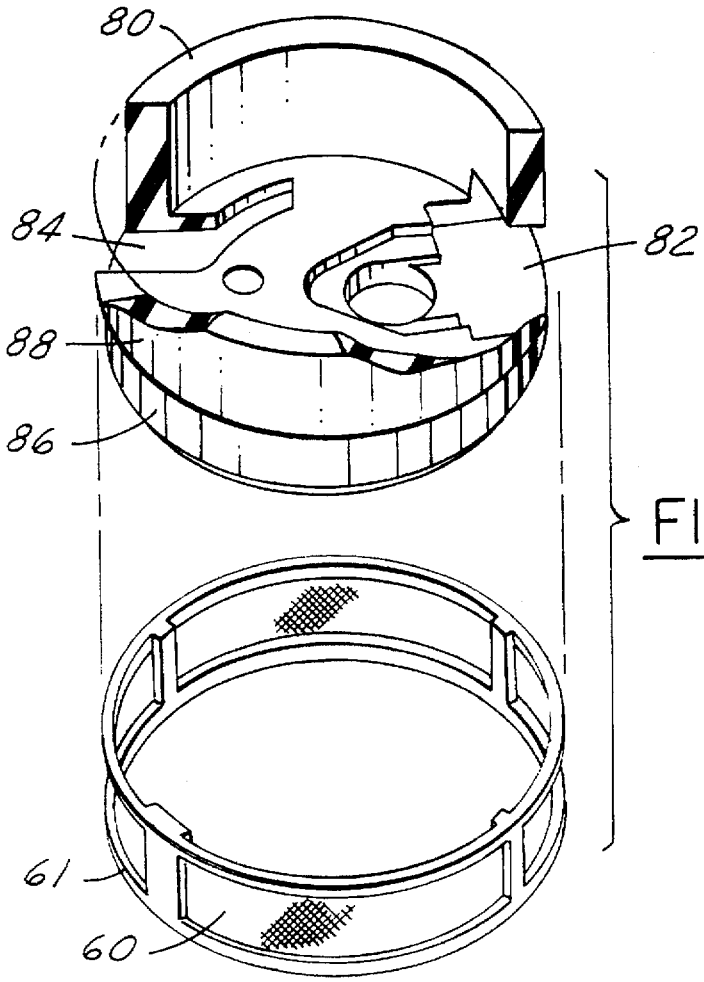
Figure 5:
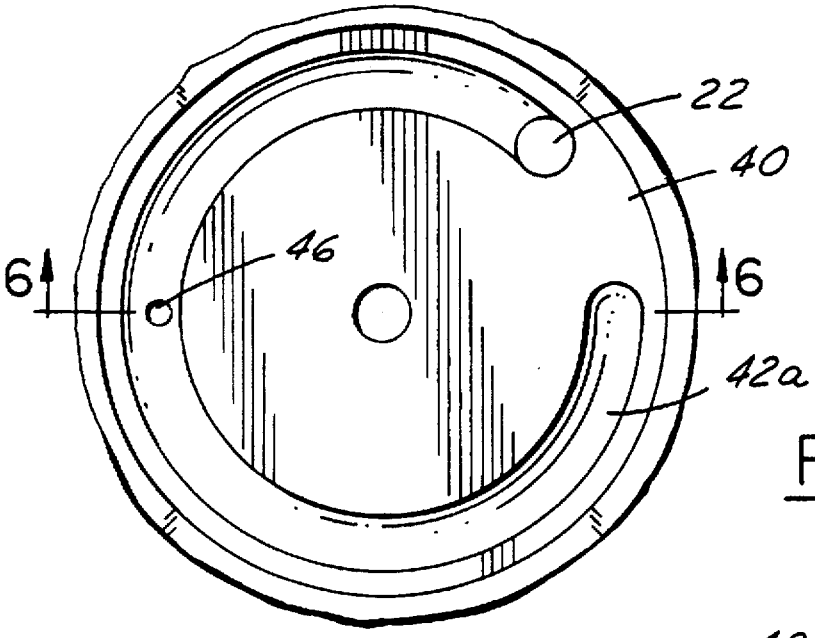
FIG. 5 is a plan view of a fuel pump cover according to the present invention.

Turning now to FIG. 7, there is shown an exploded perspective view of screen 60 and isolator 80. In a preferred embodiment, isolator 80, formed of a material sufficient to dampen vibration between fuel pump 12 and the fuel tank 20 (such as rubber), encapsulates the end of the fuel pump 12 where pump cover 40 is located. Isolator 80 has fuel inlet 82 and a vapor outlet 84 formed therein. Inlet 82 communicates with inlet 22 of fuel pump 12 and vapor outlet 84 communicates with vapor purge orifice 46. Thus, liquid fuel may flow from reservoir 14 to inlet 22 through inlet 82 while vapor may flow from vapor purge orifice 46 to vapor tower 48 through outlet 84. Isolator 80 is generally cupped shaped and has a step 86 formed in sidewall 88 for receiving screen 60. Screen 60, assembled to frame 61, fits over step 86 in sidewall 88 such that liquid fuel and vapor must pass through screen 60. Thus, screen 60 causes the vapor bubbles to reduce in size and momentum and has the added benefit of filtering particles from liquid fuel entering fuel pump 12 through inlet 82 of isolator 80.

Reservoir 14 (see FIG. 2) is formed with recess 90 for receiving isolator 80. The arrangement of the screen 60 fitting over isolator 80 and the assembly (isolator 80 and screen 60) being held within recess 90 of reservoir 14 allows for ease of manufacturing assembly as well as locating screen 60 relative to vapor tower 48.

While the best mode for carrying out the invention has been described in detail, those skilled in the art in which this invention relates will recognize various alternative designs and embodiments, including those mentioned above, in practicing the invention that has been defined by the following claims.

We claim:

1. A fuel vapor management system for an automotive vehicle having a fuel tank and an internal combustion engine, with said fuel vapor management system comprising:

a fuel pump for pumping fuel from the fuel tank to the engine, with said fuel pump having a fuel pump inlet and a fuel pump vapor purge outlet for purging fuel vapor bubbles from said fuel pump;

a vapor tower in fluid communication with said fuel pump vapor purge outlet; and, a fluid treatment element disposed between said fuel pump vapor purge outlet and said vapor tower, with said fluid treatment section reducing the size and momentum of purged vapor bubbles such that the purged vapor bubbles in said vapor tower may separate from liquid fuel, thereby allowing liquid fuel to flow out of said vapor tower and allowing fuel vapor to escape from said vapor tower away from said fuel pump inlet.

2. A system according to claim 1 wherein said vapor tower comprises a deflector for deflecting said purged vapor bubbles upward in said vapor tower.

3. A system according to claim 1 wherein said vapor tower comprises a check valve for allowing fuel vapor to escape from said vapor tower.

4. A system according to claim 1 wherein said vapor tower comprises a liquid fuel outlet for allowing said liquid fuel out of said vapor tower.

5. A system according to claim 4 wherein said vapor tower comprises a vapor tower inlet for allowing fuel vapor bubbles and liquid fuel to enter therein, with the ratio of the cross-sectional area of said liquid fuel outlet to said vapor tower inlet being such that more fuel volume enters said vapor tower than exits said liquid fuel outlet.

6. A system according to claim 5 wherein said ratio is about 1:3.

7. A system according to claim 1 further comprising an isolator disposed within the fuel tank for mounting said fuel pump therein.

8. A system according to claim 7 wherein said isolator comprises an isolator vapor purge outlet between said fuel pump vapor purge outlet and said vapor tower inlet, with said purged fuel vapor flowing through said fuel pump vapor purge outlet, through said isolator vapor outlet and into said vapor tower inlet.

9. A system according to claim 8 wherein said fluid treatment element is a screen assembled to said isolator.

10. A system according to claim 7 wherein said isolator comprises an isolator fuel inlet between the fuel tank and said fuel pump inlet.

11. A system according to claim 7 wherein said isolator is formed of a material sufficient to dampen vibration between said fuel pump and the fuel tank.

12. A fuel vapor management system for an automotive vehicle having a fuel tank and an internal combustion engine, with said fuel vapor management system comprising:

a reservoir mounted inside and in fluid communication with the fuel tank;

a fuel pump for pumping fuel from said reservoir to said engine, with said fuel pump having a fuel pump inlet and a fuel pump vapor purge outlet for purging fuel vapor bubbles from said fuel pump;

a vapor tower disposed within said reservoir and in fluid communication with said fuel pump vapor purge outlet, with said vapor tower comprising:

a vapor tower inlet at a bottom end of said vapor tower in communication with said fuel pump vapor purge outlet;

a deflector positioned in said vapor tower so as to deflect purged vapor bubbles entering said vapor tower upward therein;

a vapor tower vapor outlet at a top end of said vapor tower; and, a liquid fuel outlet at said bottom end of said vapor tower; and, a screen disposed between said fuel pump vapor purge outlet and said vapor tower inlet, with said screen reducing the size and momentum of purged vapor bubbles such that purged vapor bubbles in said vapor tower may rise therein and separate from liquid fuel, with the liquid fuel thereafter flowing into said reservoir through said liquid fuel outlet and with fuel vapor thereafter escaping from said vapor tower through said vapor outlet away from said fuel pump inlet.

13. A system according to claim 12 wherein the ratio of the cross-sectional area of said liquid fuel outlet to said vapor tower vapor inlet is such that more fuel volume enters said vapor tower vapor inlet than exits said liquid fuel outlet.

14. A system according to claim 13 wherein said ratio is about 1:3.

15. A system according to claim 12 further comprising an isolator disposed within said reservoir for mounting said fuel pump therein and for damping vibration between said fuel pump and said reservoir.

16. A system according to claim 15 wherein said isolator comprises a generally cup shaped member having:

an isolator fuel inlet disposed between said reservoir and said fuel pump inlet for allowing fuel flow from said reservoir to said fuel pump; and, an isolator vapor purge outlet disposed between said fuel pump vapor purge outlet and said vapor tower inlet for allowing said purged fuel vapor to flow from said fuel pump vapor purge outlet to said vapor tower vapor inlet.

17. A system according to claim 16 wherein said screen is a generally cylindrical screen surrounding said isolator.

18. A fuel delivery reservoir for an automotive vehicle having a fuel pump for pumping fuel from a fuel tank to an internal combustion engine, with said reservoir comprising:

a vapor tower attached to said reservoir for collecting purged fuel vapor from the fuel pump, with said vapor tower comprising a fluid treatment element at an inlet thereof for reducing the size and momentum of purged vapor bubbles such that purged vapor bubbles in said vapor tower may separate from liquid fuel.

19. A reservoir according to claim 18 wherein liquid fuel flows out of said vapor tower and into said reservoir and wherein fuel vapor escapes from said vapor tower.

20. A reservoir according to claim 18 wherein said vapor tower comprises a deflector for deflecting said purged vapor bubbles upward in said vapor tower.

* * * * *